US008920212B2

(12) United States Patent
Ullerich et al.

(10) Patent No.: US 8,920,212 B2
(45) Date of Patent: Dec. 30, 2014

(54) METHOD AND DEVICE FOR GRINDING AND POLISHING WOODEN MATERIALS AND CORRESPONDING WOODEN PARTS

(75) Inventors: Karl-Heinz Ullerich, Rednitzhembach (DE); Gerhard Brendel, Auerbach (DE)

(73) Assignee: TGC Technologie Beteiligungsgesellschaft (DE)

( * ) Notice: Subject to any disclaimer, the term of this patent is extended or adjusted under 35 U.S.C. 154(b) by 1409 days.

(21) Appl. No.: 12/527,596

(22) PCT Filed: Feb. 22, 2008

(86) PCT No.: PCT/EP2008/052196

§ 371 (c)(1),
(2), (4) Date: Dec. 20, 2010

(87) PCT Pub. No.: WO2008/102010

PCT Pub. Date: Aug. 28, 2008

(65) Prior Publication Data

US 2011/0135877 A1 Jun. 9, 2011

(30) Foreign Application Priority Data

Feb. 23, 2007 (DE) ..... 10 2007 009 020
Apr. 2, 2007 (DE) ..... 10 2007 015 910

(51) Int. Cl.

| | |
|---|---|
| ***B24C 1/08*** | (2006.01) |
| ***B27N 7/00*** | (2006.01) |
| ***B24C 3/02*** | (2006.01) |
| ***B24C 11/00*** | (2006.01) |
| *B05D 3/12* | (2006.01) |
| *B05D 7/06* | (2006.01) |

(52) U.S. Cl.

CPC ... *B24C 1/08* (2013.01); *B27N 7/00* (2013.01); *B05D 3/12* (2013.01); *B24C 3/02* (2013.01); *B05D 7/06* (2013.01); *B24C 11/00* (2013.01)

USPC ..... 451/39; 451/57

(58) Field of Classification Search

USPC ..... 144/358, 361, 364, 380, 359; 451/38, 451/39, 40, 54, 57, 60, 91

See application file for complete search history.

(56) References Cited

U.S. PATENT DOCUMENTS

| | | | | |
|---|---|---|---|---|
| 446,962 | A * | 2/1891 | Bryce | 52/316 |
| 2,345,942 | A * | 4/1944 | Lehman | 428/170 |
| 2,400,725 | A * | 5/1946 | Witham | 451/81 |
| 2,706,355 | A * | 4/1955 | Brown | 428/151 |
| 3,580,311 | A * | 5/1971 | Fox, Jr. | 144/329 |
| 4,044,507 | A * | 8/1977 | Cox et al. | 451/38 |
| 5,140,783 | A * | 8/1992 | Hoffman | 451/32 |
| 5,257,655 | A * | 11/1993 | Skendzel | 144/358 |
| 5,435,770 | A * | 7/1995 | Balentine | 451/31 |
| 6,419,566 | B1 | 7/2002 | Palmisano | |
| 6,422,920 | B1 * | 7/2002 | Bouten et al. | 451/29 |
| 6,584,820 | B1 | 7/2003 | Benedict et al. | |
| 7,201,193 | B1 * | 4/2007 | Skendzel | 144/358 |
| 2006/0099888 | A1 * | 5/2006 | Ishibashi et al. | 451/38 |

FOREIGN PATENT DOCUMENTS

| | | |
|---|---|---|
| WO | 9731752 | 9/1997 |
| WO | 0148333 | 7/2001 |

* cited by examiner

*Primary Examiner* — Timothy V Eley
(74) *Attorney, Agent, or Firm* — Price Heneveld LLP

(57) ABSTRACT

The present invention relates to a method and a device for processing parts, preferably made from timber-derived materials, especially MDF elements for achieving a sanded or polished surface, wherein blasting media are directed onto the surface at a shallow impact angle, and correspondingly produced wood parts.

17 Claims, 6 Drawing Sheets

METHOD AND DEVICE FOR GRINDING AND POLISHING WOODEN MATERIALS AND CORRESPONDING WOODEN PARTS

BACKGROUND OF THE INVENTION

1. Field of the Invention

The present invention relates to a method and a device for processing parts, preferably made from timber-derived materials, and correspondingly painted or coated timber parts.

2. Prior Art

Timber-derived materials are used in all kinds of applications, especially, for example, in the furniture industry. The timber-derived materials used there are usually coated or painted, but the term "coating" is used herein as a generic term to cover painting as well as powder coating and the like. The purpose of painting or coating is to impart an aesthetically appealing surface to the timber-derived materials.

Demands in this regard have grown increasingly in recent years, as furniture designs with, for example, high-gloss surfaces, impose much greater demands on the coating or painting. Accordingly, the methods for manufacturing such furniture entail great outlay, since diverse individual process steps, such as sanding the wood surface, intermediate sanding of already partially painted or coated surfaces and final polishing of the coated or painted surfaces, are required. Moreover, in certain circumstances, several coats or paint layers may be required, with the result that the overall process entails very great outlay.

This also applies to the recently very commonly employed wood fiber materials, such as medium density fiber board (MDF) panels, which also need appropriate pretreatment, for example, in order that fibers protruding from the surfaces may be removed prior to coating or painting.

In the prior art, this is usually achieved by sanding processes, in which abrasive media, such as corundum and similarly abrasive elements, are arranged on a carrier, such as sandpaper or a sanding wheel, so as to be moved over the surface by means of the carrier in a rotating movement or any other form of movement. The pressure exerted by means of the carrier causes the abrasive media to remove material from the surface of the part to be treated. When the abrasive media are of a suitable grain size, the outcome can be a fine, smooth and flat surface.

Similarly, painted or coated surfaces can be processed with corresponding polishing media, which in turn contain abrasive particles or powder which are taken up in an auxiliary medium, such as a liquid or a pasty medium, and are moved across the surface by means of flexible carriers, such as cloth or felt discs and the like, such that, again in turn, the abrasive media can effect corresponding material removal.

Such methods especially entail very high outlay because, for the sanding or polishing steps, the corresponding part to be processed must be arranged in a defined manner relative to the sanding or polishing device, a fact which usually entails laborious handling of the corresponding part, since a change of fixture is needed relative to the coating or paint processing. The part must usually be removed from a fixture used for the coating or painting and installed in a fixture suitable for the sanding or polishing processes and, after sanding or polishing, again be removed and installed in a different fixture, a fact which leads to highly laborious handling. Consequently, there is hardly any scope for continuous processing operations, that include coating and painting operations and the sanding and polishing operations, in a so-called inline installation.

DISCLOSURE OF THE INVENTION

Object of the Invention

It is therefore an object of the present invention to provide a method and a device which facilitate in a simple manner sanding and/or polishing steps during the processing of surfaces of parts and especially of parts made from timber-derived materials, and preferably MDF materials. The corresponding method and the device shall be easy to implement or assemble and shall yield good results in terms of surface quality.

Technical Solution

The inventors have recognized that, instead of trying to solve the aforementioned problem by the previously known methods of sanding and polishing with sanding wheels or polishing pads which establish defined contact between the abrasive media and the surface to be processed, the problem can be solved by using a blasting method in which the blasting media to be used for blasting impinges on the surface to be processed at a shallow angle. This blasting application removes the tips of the surface and leads to levelling and smoothing in the same manner as is known for mechanical polishing and sanding. Especially in the case of timber-derived materials, protruding fibers are broken off by the impinging blasting media, so that all troublesome projections are removed.

This method obviates the need to arrange the workpiece or part to be processed in a defined manner relative to the contact surfaces of the polishing or sanding devices, and so short processing times are ensured on account of eliminated clamping operations. For example, in connection with powder coating methods, as well as other painting processes, in which the workpiece to be processed is accommodated in a fixture and moved past the coating or painting devices in order that it may be continuously coated or painted, there is no need for laborious re-clamping of the part. For example, in the case of methods in which the drying and/or hardening steps, too, are continuous and the corresponding part is accommodated in the same fixtures or holders as in the case of coating and/or painting methods, a significant gain in process effectiveness is ensured. Thus, an aspect of the inventive method or the corresponding device can be employed advantageously in the context of methods in which parts are held in a single holder or fixture in which, both coated and dried, they can then be prepared, e.g., sanded or post-processed, e.g., polished. An aspect of the present invention also makes all intermediate steps feasible in a simple manner. Thus, in an aspect of the inventive method, when, for example, MDF panels or other timber-derived materials are being coated or painted, the corresponding part need only be arranged in a fixture or holder at the beginning and can remain in this fixture or holder until final polishing, passing through all processing steps, such as priming with a primer, sanding, coating or painting in various coating steps, with intermediate sanding and the like, as well as final polishing. This leads to a very effective and efficient way of working.

In an aspect of the inventive method, which can be described as blast sanding or blast polishing, or in the corresponding device, the jet of blasting media is directed onto the surface at an impact angle $\alpha$ between the surface to be treated and the principal blast direction of at most 60°, especially less than or equal to around 45°, especially less than or equal to 30°, preferably not more than 20° and especially preferably not more than 10°. Above all, angles in the range between 10° and 20° and especially between 10° and 15° have proved to be very advantageous. Given lower demands on the quality of the surface, an angle of 45° is also advantageous, because then all sides of rectangular parts can be treated with the same blaster. Since a corresponding jet from a corresponding blasting nozzle or the like usually diverges, the angle must be seen in relation to the principal blasting direction, which represents the midline of the overall jet.

When a part, such as a wood fiber board or MDF panel, is being treated, it can be advantageous, e.g., when all areas have to be treated to approximately the same quality level, for the jet of blasting media to be directed at the surface to be processed such that the blasting media do not strike areas adjacent to the surface, or do not impinge on the adjacent areas at an impact angle greater than the impact angle between the principal jet and the surface to be processed. This ensures that the adjacent surfaces are not damaged or ablated by the blasting media, which could happen if the blasting media impact on the adjacent surfaces at too great an impact angle. In certain cases, however, this can be desired when, for example, the material at narrow end faces or corresponding edges is to be compacted. In this case, the jet of blasting media can be trained over the borders or edges without further ado.

The outcome of that, however, is that the surface to be processed cannot be fully processed with certain jets of blasting media in certain cases, since the border region of said surface is, for example, adjacent a region where a surface is arranged at one edge, with the surface pointing towards the jet of blasting media, i.e., it has a surface normal, which faces vectorially towards at least a portion of the direction of the blasting media. This harbors the danger that this adjacent surface could be damaged or undesirably processed by the jet of blasting media.

In such a case, a second jet of blasting media can be provided which has an opposite principal blasting direction, but, impinges on the surface to be processed at an angle of the same or similar value. In the region in which the adjacent surface abuts the surface to be processed, for example in the region of an edge, this jet then necessarily does not impinge on the adjacent surface since the adjacent surface is in the blasting shadow. Similarly, this second jet of blasting media of opposite blasting direction can process over and beyond the border in those regions in which the first jet of blasting media cannot be used as far as the border of the surface to be processed, such that full-surface processing of the surface to be processed is facilitated. Accordingly, it can be advantageous to provide several pairs of jets of blasting media with opposite blasting directions.

In the case of a square or oblong part, at least two jets of blasting media can thus be provided for each surface to be processed, said jets of blasting media, for example, being aligned parallel with a longitudinal edge. Regarding the longitudinal edge, there are no problems in the border region with adjacent areas, and so the surface to be processed can be processed as far as the edge, that is as far as and beyond the edge.

In the case of those edges of the surface to be processed which are transverse to the blasting direction, it depends on whether the adjacent area contiguous with the edge is arranged in the direction or in the vicinity of the blasting source, or facing away from it. The adjacent area facing away is located in the shadow region of the jet of blasting media, so that here, too, processing as far as the edge is possible. Relative to the edge facing the blasting source, a safety distance can be maintained, so that processing of the surface to be processed takes place only in a region at a distance therefrom.

By means of a second jet of blasting media, which is arranged opposite the first jet of blasting media, the border region in the region of the edge that cannot be processed by the first jet of blasting media can be processed, such that, here too, the entire surface to be processed can be covered.

These principles can be transferred to any shape of surface, with attention having to be paid to how the corresponding edges or area transitions and the corresponding adjacent surfaces are aligned with each other. Accordingly, it may be necessary to employ a plurality of jets of blasting media.

The blasting media can be grains or spheres or other particles made from any suitable material, e.g., organic and inorganic substances, such as natural products, (e.g., nutshells, e.g., walnut shells), glass, plastic, metal, (e.g., metal alloys, e.g., aluminium or steel), sand, gravel, ceramics, oxides, nitrides, carbides, diamond or diamond-like substances, quartz, corundum, silicon, carbide, boron nitride, dry ice, slate, precipitated chalk, tin ash, cerium oxide or combinations thereof. All abrasive media are suitable which find application as sanding media or polishing media. The particle grains or spheres can have all kinds of sizes, with not just one grain size distribution being present within the blasting media, but basically blasting media with different average grain sizes being suitable. Naturally, the corresponding intended use also plays a role. For sanding operations, it is usual to employ blasting media with larger average particles or grain sizes, while polishing is usually performed with powder or granules having a smaller average grain size.

For polishing operations, it is also possible to use blasting media which comprise flexible carrier elements, such as cloth, felt or rubber strips, on which one or more grains or spheres of the respective blasting media are arranged. For example, cloth or felt strips can be impregnated with a suspension or slurry of abrasive media and a carrier liquid or paste. Where the very small particles make flat contact with the surface, the flexible strips cause them to be squeezed against the surface for a certain time and to sand along it so as to effect material removal of the tips or projecting fibers.

The jet of blasting media can be generated by all kinds of technologies, for example, by blasting wheel, compressed air, jet turbines and/or injector blasting installations. Accordingly, the jet can comprise compressed air and/or other gases and/or liquids, such as water or other pasty substances in addition to the abrasive media. For example, in the case of compressed air jet arrangements, a blasting nozzle of the venturi type or a venturi injector similar to a water jet pump can be used in which the outflow of compressed or pneumatic air through a nozzle entrains laterally fed abrasive media into the compressed air stream. Instead of compressed or pneumatic air, other gases or liquids, such as water, can also be used.

The inventive device can be configured such that the jet of blasting media can be moved across the surface, more precisely in different directions. Alternatively, of course, a fixed arrangement of the jet arrangements is possible, in which case the part to be processed can be moved in all kinds of directions relative to the jet. A combination of movement of the jet arrangements and the part to be processed is conceivable, too. For continuous processing of parts that are moved through corresponding processing installations, combined movement of part and jet arrangements, especially for the processing of certain areas, can be advantageous.

In all variants, full-surface coverage by the jet of the surface to be processed is assured through the mutual movement capability. The blasting direction can vary during treatment, especially, opposing or facing blasting directions can be used in alternating fashion to achieve especially good surfaces.

It is also contemplated that the impact angle α can be varied during treatment.

Where a part is moved continuously through a processing facility, the method can be configured such that one or more of the following steps can be performed:

a) Treatment of the area aligned with one transport direction by a first jet;
b) Treatment of area aligned with an opposite transport direction by a second jet;
c) Treatment of areas of the part aligned parallel with the transport direction and perpendicularly to a principal transport plane by a third jet and a fourth jet;
d) Treatment of surface(s) of the part aligned parallel with the transport direction and parallel with the principal transport plane between the front edge of the surface(s) to a region on the surface(s), which region is arranged at a distance from the rear edge of the surface, by a fourth jet, wherein the blasting direction for this treatment step is aligned with the transport direction; and
e) Treatment of the surface(s) of the part aligned parallel with the transport direction and parallel with the principal transport plane at least between the region spaced at a distance from the rear edge and the rear edge of the surface, by a fifth jet, wherein the blasting direction for this treatment step is aligned opposite to the transport direction.

In this connection, the principal transport plane T' is defined as that plane which is parallel with the principal area, e.g., the largest area of the part to be processed that includes the transport direction.

This approach can produce high quality surfaces, with the blasting media impinging on the surface, even in the region of the edges, only in the desired small angles.

The concept described in steps d) and e) can also be applied to the treatment of other surfaces/edges of the part. All steps can be carried out successively in any order, separately or in overlapping time.

Furthermore, an approach, described earlier with regard to the stationary processing of parts, can of course be applied to moved (e.g., linearly, continuously moved) parts. Here, it may be advantageous for jet arrangements for processing of certain surfaces to be moved along with the part for the duration of the processing time, e.g., in the case of areas that are arranged transversely, e.g., perpendicularly, to the transport direction T and to the principal transport plane T'.

However, it can also be advantageous, e.g., in the case of panel-like parts, for the jet to be moved beyond the borders of the surface to be processed or correspondingly conversely, the part, such that, for example, end faces of a panel, which are usually a cut side, are additionally compacted by blasting media impinging at a greater angle. This leads to good edge protection. Here, too, it is possible to have a combination of compaction, e.g., compaction carried out at the beginning of processing and large impact angles (greater than the cited shallow sanding or polishing angles), and subsequent sanding and/or polishing at shallow impact angles.

As part of the method, it may be important to dose the blasting media for an exact time, such that the blasting media is prevented from impinging on areas which are not intended for blasting (e.g., in a different angle than the impact angle in the context of the invention).

To this end, jets of blasting media can be switched on and off accordingly.

This can be achieved by appropriate control of the jet, for example through the use of fast switching valves.

In a further embodiment, control can be effected via dosing the blasting media. In this connection, initially a quantity of blasting media is calculated which is limited such that, for example, a surface is only partially treated. The required quantity of blasting material is calculated via the throwing rate of the turbine, the relative transport rate and the surface blasting rate.

An embodiment of inventive method may be used as a sanding step for preparing a coating step, e.g., prior to painting or powder coating of a timber part (e.g., an MDF part).

Before implementation of the sanding step by means of blasting treatment, the surface can be sealed with a primer, with the primer being a waterborne or solventborne paint. This has an advantage of embrittling the surface or protruding parts or regions, such as fibers, a fact which leads to easier ablation during blast sanding.

Alternatively, after a first sanding step by means of blasting treatment, the surface can be sealed with a primer, with the primer again being a waterborne or solventborne coating. Subsequently, a second sanding step by means of blasting treatment can occur, after which painting or powder coating may occur.

Moreover, an embodiment of the present method can serve as any intermediate step or as a polishing step after a coating process or finishing process.

A correspondingly treated surface is characterized not only by levelling of the tips or breaking off of protruding fibers, but also by the fact that a compacted surface region is generated by the impinging blasting media.

An aspect of the present invention also relates to a device which comprises at least one blasting installation, an inlet lock and/or an outlet lock.

The inlet lock and/or the outlet lock have at least two opening and closing blocking elements, which can be actuated synchronously such that at least one of the blocking elements is always closed during operation of the blasting installation in order that the blasting media may be prevented from exiting a blasting region. The part to be treated is transported in the transport direction, first into the inlet lock, then into the blasting installation for treatment with the blasting media, and then into the outlet lock. The inlet lock, the blasting region and the outlet lock can be arranged as chambers arranged one behind the other.

In the context of an embodiment of the invention, the inlet lock and/or the outlet lock is formed such that even light blasting material from the blasting region is prevented from leaving the inlet lock and/or the outlet air lock. The construction of the inlet lock and/or the outlet lock is characterized in each case by at least two blocking elements, between which a spreader beam with the part to be treated may be arranged. The blocking elements can be capable of synchronous actuation, such that at least one of the blocking elements always keeps the lock closed while the blasting installation is in operation. Accordingly, inlet and/or outlet locks can be designed such that the opposing openings of a flow-through chamber are never open at the same time but rather always opened separately.

The sequence of the transport of a spreader beam with a part can be described as follows:

a) Opening of the entrance blocking element, while the exit blocking element is closed (this ensures that, during transport of the spreader beam with the part into the inlet lock, another part can be treated inside the blasting installation without blasting material penetrating into the inlet lock);
b) Closing of the entrance blocking element and opening of the exit blocking element;
c) Transportation of the spreader beam with the part into the blasting installation and treatment of the part;

d) Opening of the entrance blocking element of the outlet lock while the exit blocking element of the outlet lock remains closed;

e) Transportation of the spreader beam with the part into the outlet lock; and (f) Closing of the entrance blocking element of the outlet lock and subsequent opening of the exit blocking element of the outlet lock, transportation of the spreader beam with the part out of the installation.

BRIEF DESCRIPTION OF THE FIGURES

Further advantages, characteristics and features of the present invention are apparent from the following detailed description of embodiments using the enclosed drawings. The drawings show in purely schematic form in:

FIG. 7 a schematic representation of an inventive treatment sequence in a plan view;

FIG. 1 is a purely schematic side view of a part 1 to be processed, for example, an MDF panel, which is accommodated and held firmly in a fixture, for example, a clamping device 2. Preferably, the clamping device 2 can facilitate suspension of the part 1, so that the part 1 can be moved through the installation on a rail system. Alternatively, the MDF panel can be suspended from hooks.

In relation to the clamping device 2, several blasting nozzles 3 are arranged, which blast a jet 9, comprising blasting media, onto the surface of the part 1 at a shallow angle $\alpha$.

Figure 1:
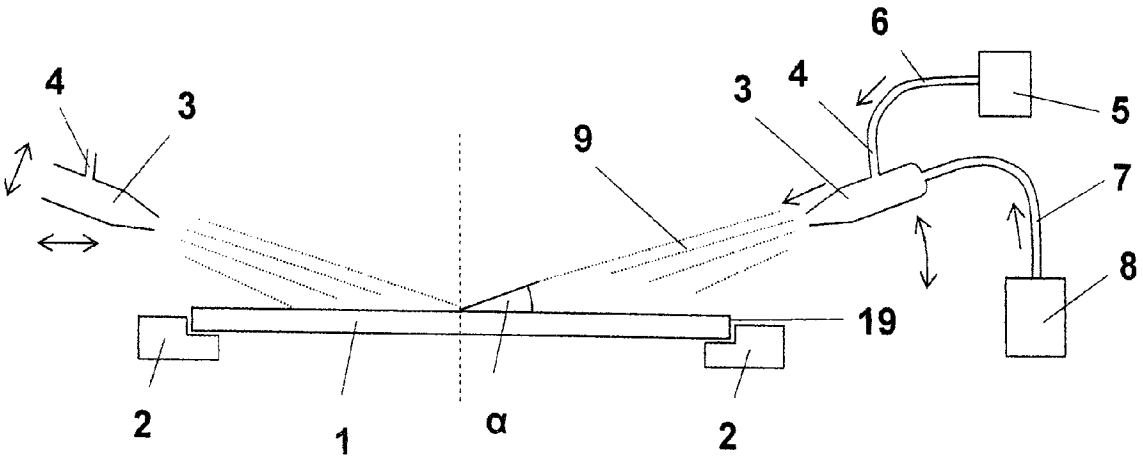
FIG. 1 a side view of a first embodiment of an inventive device for implementing the inventive method.

The illustration in FIG. 1 shows two opposing blasting nozzles 3, which direct each jet 9, towards each other, onto part 1. These nozzles 3 can alternate the jets 9 of opposing blasting direction onto the part, such that protruding wood fibers are moved back and forth such that they break. Alternatively or in addition, several blasting nozzles can be provided side by side, with parallel or at least co-directing jets 9, as can be seen for example in FIG. 3 in a plan view. Overall, several, (e.g., equidistant) jet arrangements can be provided about the part 1.

Figure 3:
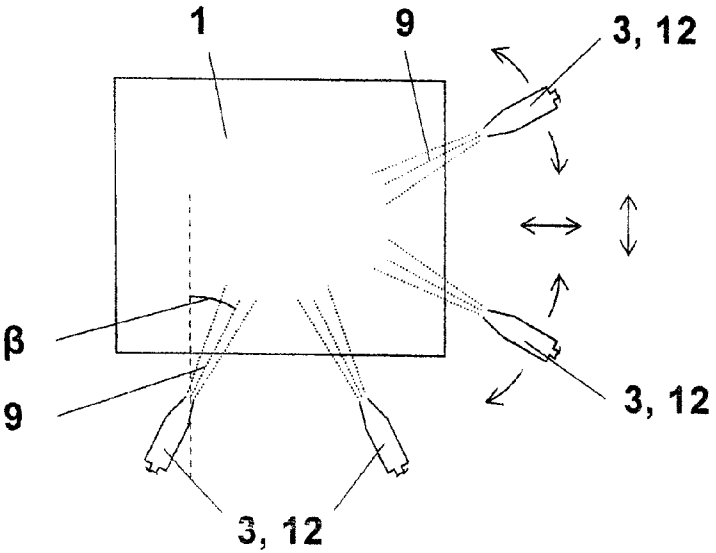
FIG. 3 a plan view of a device according to FIG. 1 or 2.

The blasting nozzles 3 are arranged so as to be movable, such that at least one type of movement is possible. The blasting nozzles can be movable in different directions or about different rotational axes, such that a variable deployment of the jet 9 relative to the surface of the part is possible. As indicated by the double arrows in the FIGS. 1 and 3, the blasting jets 3 can be swivellable first about a rotational axis parallel with the surface of the part 1 to be processed, such that the blasting or impact angle $\alpha$ is variable within a given range, for example in a range from 0° to 60°, preferably 5° to 20°. Additionally, the blasting nozzles 3 can be moved in relation to the part 1, more precisely parallel with the borders of the part 1 or perpendicular to it. Furthermore, a swivelling or rotation can occur about an axis of rotation perpendicular to the surface to be processed, such that the blasting angle $\beta$, as shown in FIG. 3, is changeable. The blasting nozzles 3 can be moved such that the jet can be moved across the entire surface to be processed. Alternatively, it is also possible to provide a fixed arrangement of blasting nozzles 3, but to render the clamping device 2 of part 1 or the part 1 itself so as to be movable, such that the part 1 is moved underneath and through the blasting nozzles 3 or past them. It is especially advantageous for the jet 9 or the part 1 to be moved, such that the jet 9 strikes not only the entire surface of the part 1, but also adjacent end faces 19, since, here, the impinging jet simultaneously compacts the surface material, said compaction being advantageous for the cut sides of cut panels.

The blasting nozzles 3 of the embodiment of FIG. 1 are pneumatic or compressed air nozzles 3, in which compressed air generated in a compressed-air-generating device 8 is fed to the nozzles 3 via a feed line 7 and discharged via the nozzle 3. Since the blasting nozzles 3 in the region in front of the nozzle has a side feed 4, blasting media from blasting media hopper 5 which are fed to the side feed 4 via a feed line 6 are entrained by the compressed-air jet and fed with the compressed air or pneumatic air in jet 9 onto the surface of the part 1. Via the compressed air, which is delivered to the nozzle at a pressure of up to 10 bar, typically 2 to 5 bar, jet speeds of about 10 m/s are adjusted. Depending on the chosen blasting medium, speeds up to 90 m/s are conceivable, too.

The blasting media impinging with this speed on the surface of the part 1 can cause fibers protruding from a part 1 made from timber-derived materials (e.g., MDF panels) to be broken off to yield a smooth, polished surface. In the case of an already coated or painted surface, blasting at shallow angles also breaks off and levels irregularities, such as tips and the like, so that even here a correspondingly smooth surface with few irregularities and roughness is generated. Depending on the intended use, it is self-evident that the blasting media may take different forms. For coarser processing of rougher and more uneven surfaces, blasting media of larger grain diameter are used than is the case for polishing operations in which correspondingly fine blasting media are used.

Figure 2:
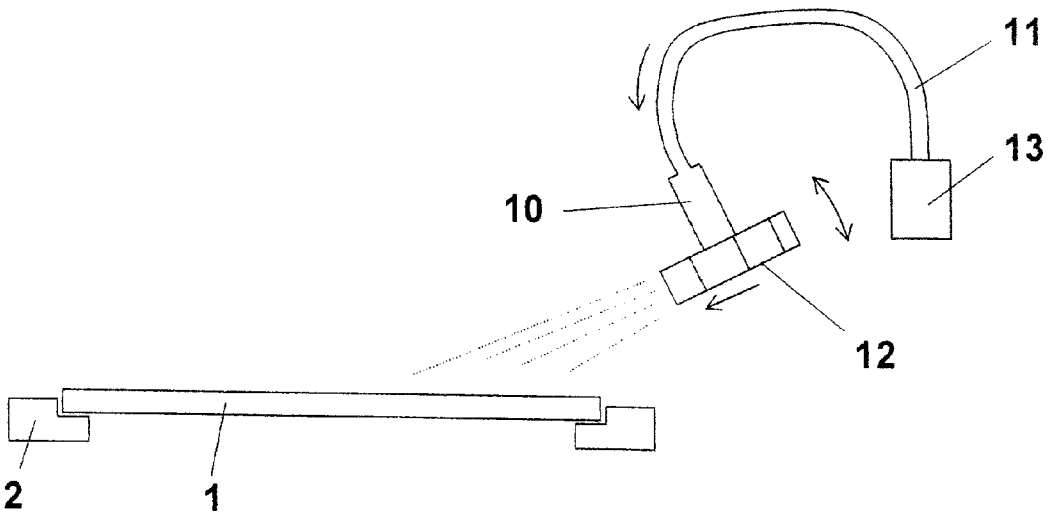
FIG. 2 a side view of a second embodiment of an inventive device for implementing the inventive method.

FIG. 2 shows a purely schematic side view of a second embodiment of a corresponding device for the treatment of parts (e.g., wood parts under shallow impact angle). The embodiment of FIG. 2 differs from that of FIG. 1 in that a different jet configuration is used, while the fixture device for the part 1 is identical and therefore has an identical reference number as that of the embodiment of FIG. 1.

The jet configuration of FIG. 2 is a blasting wheel turbine 12, which has a lateral suction 10, through which blasting media are sucked from blasting media reservoir 13 via a feed line 11, and are then discharged via the blasting wheel turbine 12 perpendicularly to the suction direction. Here, there is no need for an additional arrangement for generating a carrier agent, such as compressed air in the embodiment of FIG. 1, as, on account of the blasting wheel turbine 12, the blasting media can be applied to the surface of the part 1, without additional auxiliary. However, it is self-evident that the blasting media reservoir 13 can contain a mixture of a blasting media and an auxiliary, such as a liquid or a paste-like carrier agent.

FIG. 3 shows a plan view of the arrangement of the nozzles 3 or blasting wheel turbines 12 around the part 1 to be processed.

In accordance with the embodiment, as shown in FIG. 3, provided on each of two adjacent sides of the part 1, which are perpendicular to each other, are two nozzles 3 or blasting wheel turbines 12, which can blast the surfaces of the part 1 at different blasting angles β. The blasting angle β is defined, for example, as the angle between the principal blasting direction of the jet 9 and the normal of the side. The blasting angle β, for example, can be varied in a range from −45° to +45°. There is naturally the possibility here of moving the nozzles 3 or the blasting wheel turbines 12 to and fro along the corresponding side in accordance with the double arrow shown, and perpendicularly to the side on which they are arranged, such that overall full blasting of the entire surface of the part 1 is possible.

Figure 4:
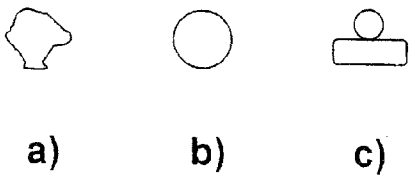
FIG. 4 in sub-figures a) to c), a description of blasting media.
Figure 4:
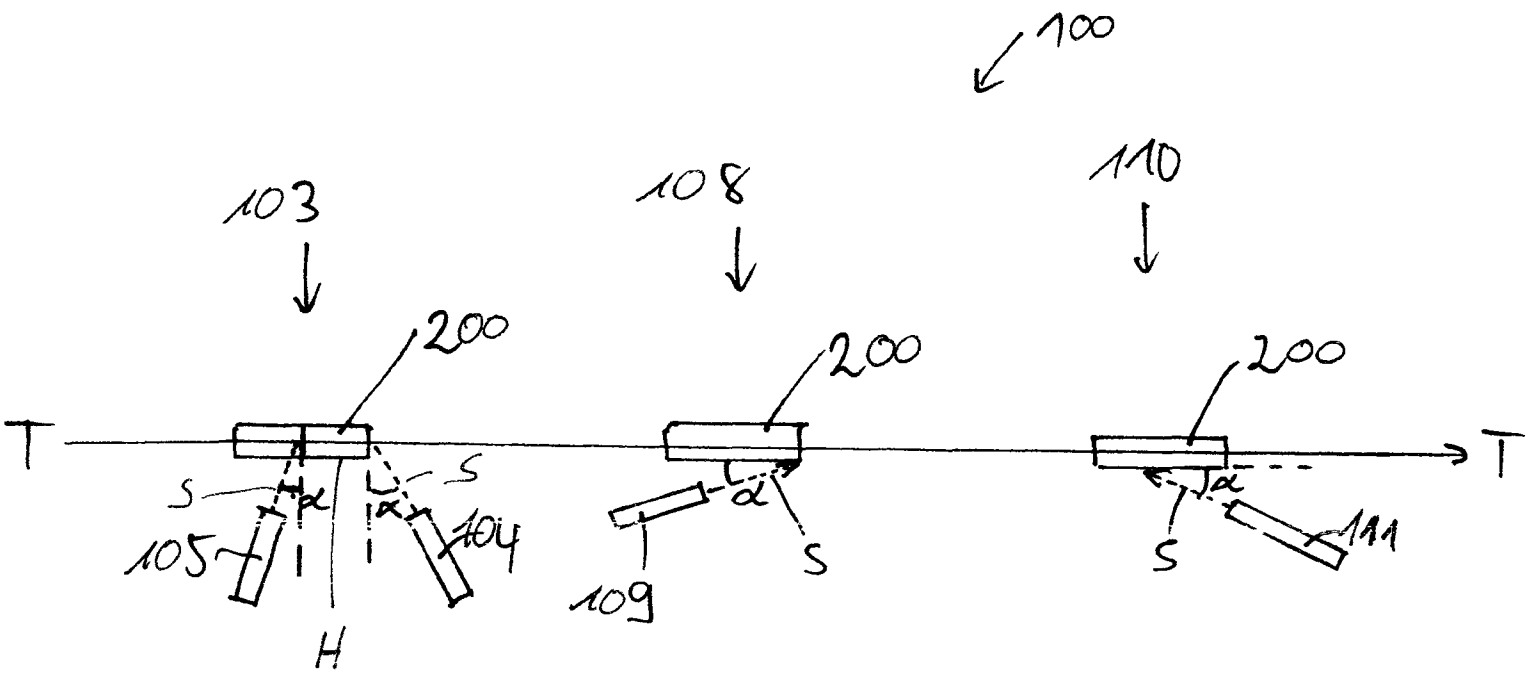

Sub-figures a) to c) of FIG. 4 show possible forms of blasting media. Besides arbitrarily shaped grains, which are shown in sub-figure a), spherical shapes (sub-figure b)) are normally used. The grains are characterized by sharp, angular surfaces, while the spheres have a smooth round surface.

Usually blasting media made from metal, such as metal turnings, wire sections and the like, as well as oxides, carbides, nitrides, corundum, ceramics and the like are present in grain form. Spherical forms are typically encountered with glass, plastic and the like, although of course any suitable material can exist in one form or another.

In addition, blasting media may be used in which, for example, small cloth or felt sections, i.e. flexible elements with corresponding abrasive components, for example, grains or spheres are wetted. This is possible, for example, if corresponding cloth or felt sections are impregnated with suspensions of abrasive elements and correspondingly liquid or pasty additives.

Figure 5:
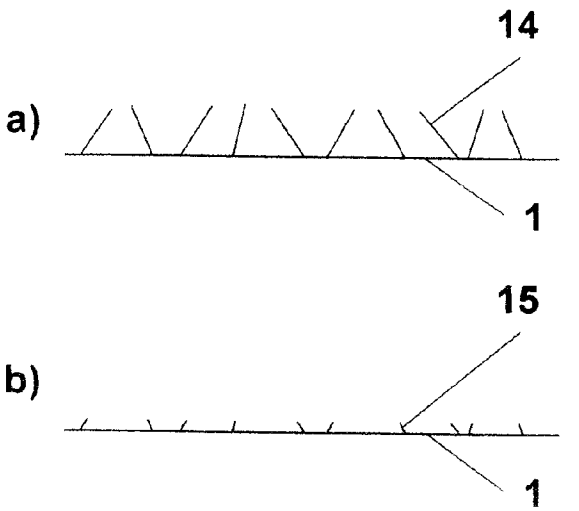
FIG. 5 in sub-figures a) and b), a side view of a surface to be processed, before processing a) and after processing b)
Figure 6:
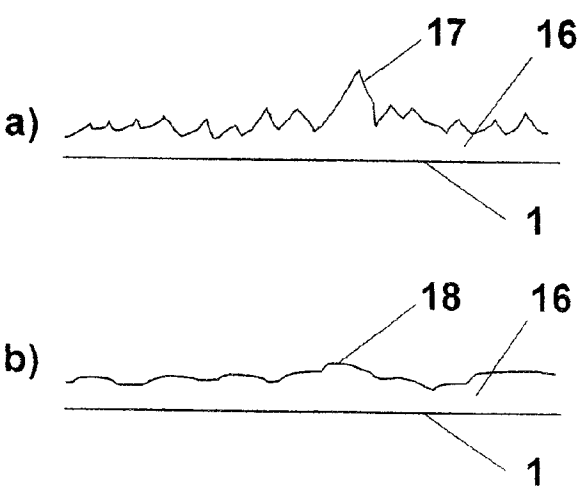
FIG. 6 in sub-figures a) and b), a side view of a surface to be processed a) and the processed surface b).

The sub-figures of FIGS. 5 and 6 show the effect of an embodiment of inventive method on one hand for wood surfaces (FIG. 5) and coated or painted surfaces (FIG. 6).

In the case of wood surfaces, it is usual for wood fibers to protrude from the surface. This is schematically shown by the fibers 14 on the part 1 in sub-figure a) of FIG. 5. After blasting at a shallow angle, the wood fibers 14 are broken off, so that only wood fiber stumps 15 are present on the surface of the part 1, but these no longer impair the smooth, flat surface.

In a similar manner in the case of, for example, coated or painted surfaces, a coat of paint 16 present on the part 1 and having tips 17, as shown in sub-figure a) of FIG. 6, is modified by blasting treatment at a shallow impingement angle such that the mountains 18 of the coating layer 16 on the part 1 are levelled (see sub-figure b) of FIG. 6).

FIG. 7 is a schematic illustration of a further treatment device 100 for sanding and/or polishing a part 200.

The part 200 is transported along a transportation route T in a transport direction, which is indicated by an arrow. Here, the various surfaces of the part 200, which, for example, is formed as a flat element with edges, are treated in some cases one after another, sometimes simultaneously.

In a first station 103, the front face at the front edge of the part is treated with the jet S from a blasting turbine or pressure blasting nozzle 104, which delivers blasting media onto the surface to be treated at an angle α of between 10° and 20°. In the same way, the rear face at the rear edge of the part 200 is treated with a jet S from a further jet blasting turbine or pressure blasting nozzle 105, with the blasting media, too, impinging on the rear surface at an angle α of between 10° and 20°. In order that blasting of the principal surface H may be avoided, the jets S of the nozzles 104 and 105 are directed only onto that region which lies on the side which, relative to the jet arrangements, faces away from the line which is given by the transport direction. Similarly, further jet arrangements (not shown) may be provided in mirror-image symmetry relative to the transport line.

Figure 8:
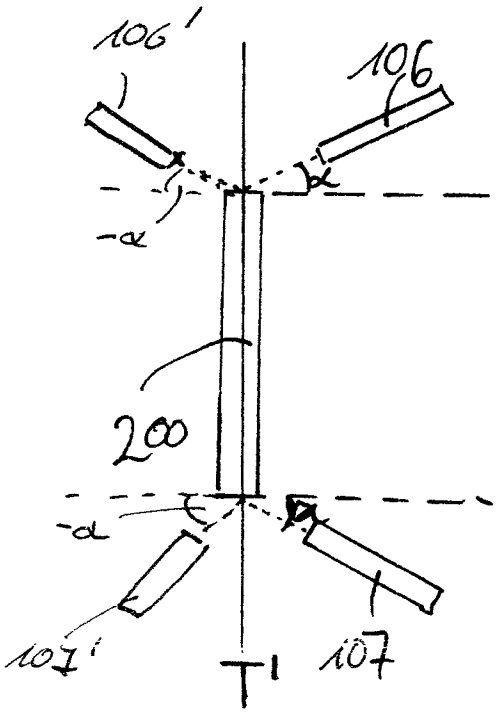
FIG. 8 a view of the device shown in FIG. 7 perpendicular to the transport direction, and FIG. 9 an arrangement of installation parts in accordance with the present invention, and in FIG. 10 a representation of the processing of quadratic faces.

As shown in FIG. 8, the upper and the lower edge of the part 200 are treated in the same or a subsequent step with jets of blasting media, which are generated by blasting turbines or pressure blasting nozzles 106 and 107 or 106' and 107' respectively. Shown here, too, are the aforementioned mirror-symmetrically arranged of nozzles 106' and 107', which generate jets which have blasting directions opposing those of the nozzles 106 and 107, but impinge at the same value of the angle α. The processed region in this regard is on the side of the nozzles 106 and 107, expressed in terms of the principal transport plane T'. Correspondingly, blasting material impinges on the respective surface of part 200 to be treated at an angle of between 10° and 20°.

FIG. 8 shows that the part 200 is essentially a flat panel. It moves along the transport direction T, its central axis thereby defining a principal transport plane T'. As shown in the embodiment, the principal transport plane T' can be oriented essentially vertically but, in principle, transversely or horizontally as well, during transport.

In a further treatment step at process station 108 (see FIG. 7), sub-regions of the flat surfaces, which are arranged parallel with the principal transport direction T' and parallel with the transport direction T, are treated. A blasting turbine, pressure blasting nozzle or a blasting wheel 109 delivers blasting media onto the surface to be treated at an angle α of between 10° and 20°. The component of the jet S which is parallel with the transport plane is aligned with the direction of the transport direction in this regard. The surface is sanded or polished away from the front edge to a region approximately in the middle of the surface to be treated.

The remaining region of the surface is treated in a subsequent treatment step at process station 110, wherein a blasting turbine, pressure blasting nozzle or blasting wheel 111 again delivers blasting material onto the surface at an angle of between 10° and 20°. The component of the jet S of the blasting media parallel with the transport direction, however, is aligned opposite to the transport direction.

The installation, especially as regards the process stations 108 and 110, can be furnished symmetrically on both sides, relative to the transport direction T, with blasting devices, such that both surfaces of the part 200 can be treated with high quality. The process stations 108 and 110 can also be integrated into a single processing station.

The inventive arrangement whereby the blasting turbine, pressure blasting nozzle or a blasting wheel 9 and 11 having a blasting direction S in the direction of or opposed to the direction of transport T, prevents blasting media with angles deviating markedly from the blasting direction a from occurring and roughening one of the surfaces or edges to be treated in the case of board-like surfaces.

Figure 9:
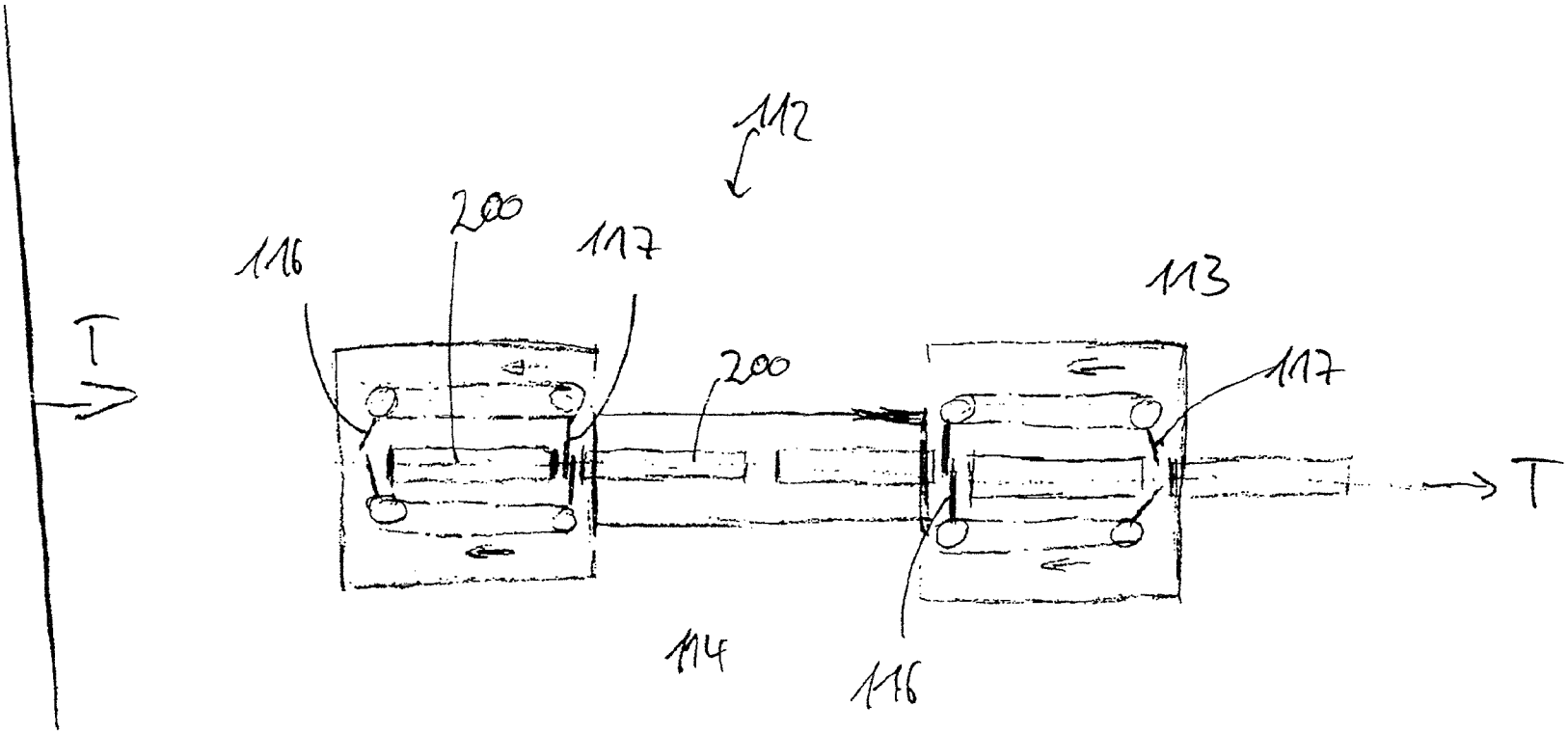

FIG. 9 shows an installation concept 112, which prevents the blasting media from the blasting installation 113 from exiting the system 112.

The installation concept 112 has an inlet lock 114, a blasting installation 113, inside of which parts 200 arranged on a spreader beam are treated, and an outlet lock 115.

The inlet lock 114 and the outlet lock 115 can be identically formed. They each have an entrance blocking element 116 and an exit blocking element 117, which can be optionally opened or closed. The elements 116 and 117 can, for example, be formed as rubber aprons or lamella, which absorb the energy of the absorbing blasting material and prevent the blasting material from penetrating when the element is closed.

The elements 116 and 117 can be synchronously opened and closed, so that at least one of the elements 116 or 117 is always closed. In this way—by analogy with a lock concept—a part 200 is transported into the inlet lock 114 or the outlet lock 115 between the blocking elements 116 and 117 when the entrance blocking element 116 is open and the exit blocking element 117 is closed. Subsequently, both blocking elements 116 and 117 are closed. Then, with the entrance blocking element 116 closed, the exit blocking element 117 is opened, so that the part 200 may be transported out of the entrance lock 114 or the outlet lock 115.

The blasting material exiting the blasting installation 113 thus always impinges on at least one closed blocking element 116 and/or 117 and cannot leave the installation.

In the embodiment of FIG. 9, the exit blocking elements 117 and entrance blocking elements 116 are arranged on a peripheral endless belt, such that they execute the corresponding opening and closing operations in synchronicity with the movement speed of the part 200 to be processed. Furthermore, the embodiment of FIG. 9 shows that, for each entrance and exit lock, two entrance blocking elements 116 and two exit blocking elements 117 are provided, which complement each other in the manner of folding elements, similar to the doors of a set of double doors. Obviously, other opening and closing elements are conceivable.

Figure 10:
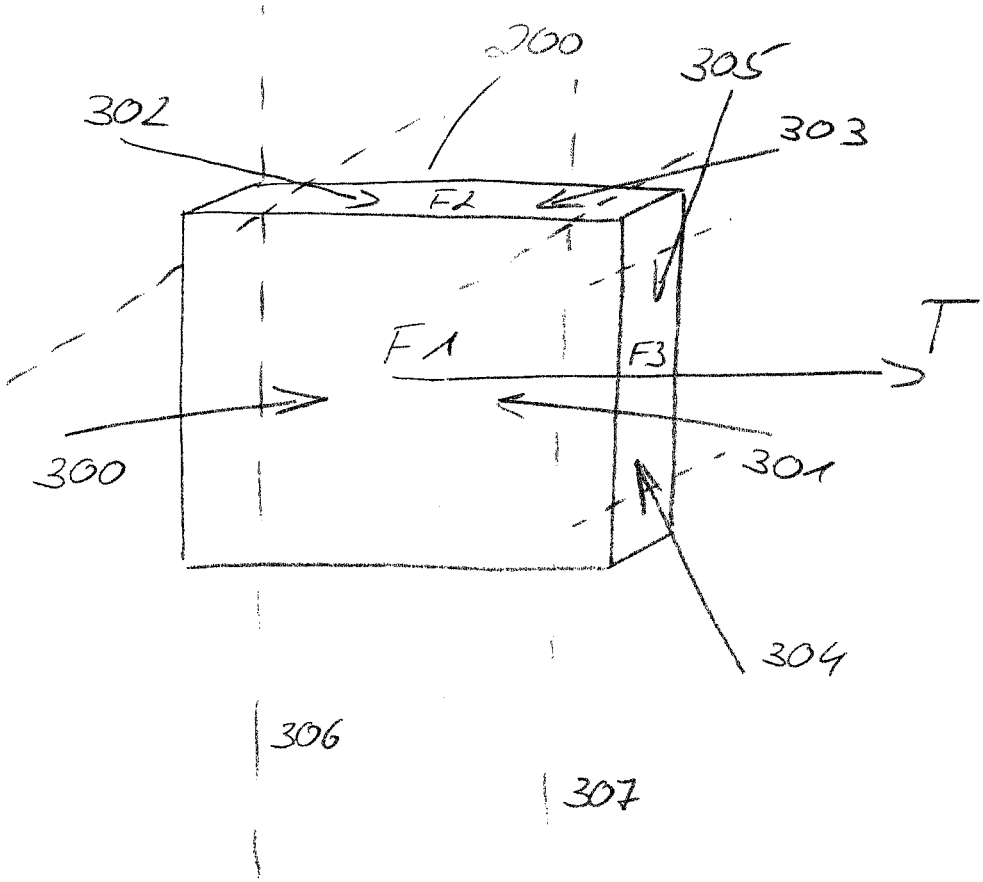

FIG. 10 shows a square with a principal face F1 and the end faces F2 and F3. With regard to these faces F1 to F3, the jets 300 to 305 are shown processing the respective faces. The face F1 is processed by the jets 300 and 301, which are formed parallel with the longitudinal edges between the faces F1 and F2 or of the corresponding floor face. Relative to these edges, the processing jet 300 and also the processing jet 301 can process the face F1 to as far as the border region, since blasting media passing over the edge does not impinge on the face F2 arranged perpendicularly to face F1 or correspondingly on the floor face arranged on the opposite side.

The situation is different, however, for that edge arranged transversely to the blasting nozzles 300 or 301 between the faces F1 and F3 or for the corresponding edge on the opposite side. There, the jet 300 is non-critical with regard to the edge between the faces F1 and F3 since the face F3 is in the shadow region. For the face opposite face F3, the same applies to the jet 301. However, the jet 300 is critical in the case of this edge since excessive blasting particles that do not impinge on face F1 would impinge on the adjacent face at too great an angle where they could cause damage. Only in the event that compaction of the corresponding end face is planned, can a corresponding impact of the blasting particles at a large impact angle be provided.

Correspondingly, in accordance with the dashed line 306, the impact area for the jet 300 is located at a distance from the corresponding edge or, in accordance with the dashed line 307, for the jet 301, at a distance from the edge between F1 and F3. The same applies to the jets 302 and 303 and 304 and 305 and dashed lines shown there, which mark the end of the impact region. With regard to the jets 300 to 303, in the event of a transport direction in accordance with arrow T, the jet arrangements can be set up so as to be stationary, since the blasting region can be defined by the beginning and ending of blasting in coordination with the movement of the part. The situation is different in the jet arrangements for jets 304 and 305, in which the jet arrangements have to be moved correspondingly or the jet itself covers a large region. Correspondingly, the jet arrangements responsible for the jets 304 and 305 can be configured such that they are moved with the part 200 for a certain length of time in the transport direction T in order that sufficiently long blasting may be assured.

Although the present invention has been described in detail using the enclosed drawings, it is clear to a person skilled in the art that modifications or amendments to the embodiments, especially through different combinations of individually shown characteristics or the elimination of individual characteristics, are possible, without surrendering the scope of protection of the enclosed claims.

The invention claimed is:

1. A method for processing parts made from timber-derived materials for leveling or flattening a surface comprising:

directing a blasting media in a plurality of jets from a plurality of nozzles onto a surface of a part at a shallow impact angle, wherein directing the blasting media comprises directing the blasting media in a first jet of the plurality of jets having a first blast direction and a second jet of the plurality of jets having a second blast direction, the first blast direction and the second blast direction having substantially similar impact angles with the surface and the first blast direction opposing the second blast direction.

2. The method in accordance with claim 1, wherein:

the shallow impact angle is less than or equal to 45° relative to the surface.

3. The method in accordance with claim 1, wherein:

the at least one jet is directed onto the surface such that the at least one jet does not strike areas on the surface which are adjacent to a region of an edge of the part.

4. The method in accordance with claim 1, wherein:

the blasting media comprises a plurality of particles made from at least one of the group comprising organic and inorganic substances, natural products, nutshells, walnut shells, glass, plastic, metal, metal alloys, aluminum, steel, sand, gravel, ceramics, oxides, nitrides, carbides, diamond or synthetic diamond substances, quartz, corundum, silicon, carbide, boron nitride, dry ice, slate, precipitated chalk, tin ash, cerium oxide and combinations thereof.

5. The method in accordance with claim 1, wherein:

the blasting media comprises at least one carrier element selected from the group comprising cloth, felt and rubber strips with a plurality of particles arranged thereon made from at least one of the group comprising plastic, glass, metal, sand, gravel, ceramics, oxides, nitrides, carbides, diamond or diamond-like substances, quartz, corundum, silicon, carbide, boron nitride, dry ice, slate, precipitated chalk, tin ash, cerium oxide and combinations thereof.

6. The method in accordance with claim 1, further including:

moving the at least one of the plurality of jets relative to the surface.

7. The method in accordance with claim 1, further including:

continuously moving the part relative to the plurality of jets.

8. The method in accordance with claim 1, further comprising:

treating a first area aligned with a transport direction of the part by the first jet of the plurality of jets;

treating a second area aligned with a direction opposite the transport direction by the second jet of the plurality of jets;

treating areas of the part aligned parallel with the transport direction and perpendicularly to a principal transport plane by a third jet and a fourth jet of the plurality of jets;

treating surfaces of the part aligned parallel with the transport direction and parallel with the principal transport plane between a front edge of the surface to a region on the surface which is arranged at a distance from a rear edge of the surface, wherein a blasting direction for this treatment step is aligned with the transport direction; and treating surfaces of the part aligned parallel with the transport direction and parallel with the principal transport plane at least between a region spaced at a distance from the rear edge and the rear edge of the surface, wherein the blasting direction for this treatment step is aligned opposite to the transport direction.

9. The method in accordance with claim 1, further including:

moving the at least one jet of the plurality of jets relative to borders of the part.

10. The method in accordance with claim 1, further including:

varying the impact angle of the plurality of jets.

11. The method in accordance with claim 1, wherein:

Directing the blasting media includes sanding the part for preparation of a coating step.

12. The method in accordance with claim 11, wherein:

the part comprises wood.

13. The method in accordance with claim 12, further including:

sealing the surface with a primer before directing the blasting media.

14. The method in accordance with claim 1, further including:

coating the part before directing blasting media, wherein the part comprises wood.

15. The method in accordance with claim 1, wherein directing the blasting media results in smoothing and leveling the surface of the part to remove fibers protruding from the surface.

16. A method for processing parts made from timber-derived materials for leveling or flattening a surface comprising:

directing a blasting media in a plurality of jets from a plurality of nozzles onto a surface of a part at a shallow impact angle, wherein directing the blasting media comprises directing the blasting media in a first jet of the plurality of jets having a first blast direction and a second jet of the plurality of jets having a second blast direction, the first blast direction and the second blast direction having substantially similar impact angles with the surface and the first blast direction opposing the second blast direction, and wherein a blasting rate of the blasting media from the plurality of nozzles is 3 m/s to 90 m/s.

17. The method in accordance with claim 16, wherein directing the blasting media results in leveling and compacting the surface to generate a leveled surface.

* * * * *

UNITED STATES PATENT AND TRADEMARK OFFICE

CERTIFICATE OF CORRECTION

PATENT NO. : 8,920,212 B2
APPLICATION NO. : 12/527596
DATED : December 30, 2014
INVENTOR(S) : Karl-Heinz Ullerich and Gerhard Brendel It is certified that error appears in the above-identified patent and that said Letters Patent is hereby corrected as shown below:

In the Specification

Col. 1, line 66;
"in line" should be --in-line--.

Col. 7, line 21;
"FIG." should be --FIGS.--.

Col. 7, line 27;
"." should be --;--.

Col. 7, line 31;
"direction, and" should be --direction;--.

Col. 10, line 6;
Please delete "of".

In the Claims

Col. 13, line 19;
"Directing" should be --directing--.

Col. 14, line 20;
"," should be --;--.

Signed and Sealed this
Ninth Day of June, 2015

Michelle K. Lee

Michelle K. Lee
*Director of the United States Patent and Trademark Office*